United States Patent [19]

Hara et al.

[11] Patent Number: 4,793,273

[45] Date of Patent: Dec. 27, 1988

[54] AUTOMATIC THREAD TENSION DEVICE FOR A SEWING MACHINE

[75] Inventors: Kazumasa Hara, Hino; Akiyoshi Sasano, Musashino; Mikio Koike, Oume, all of Japan

[73] Assignee: Janome Sewing Machine Co., Ltd., Tokyo, Japan

[21] Appl. No.: 27,490

[22] Filed: Mar. 17, 1987

Related U.S. Application Data

[63] Continuation-in-part of Ser. No. 783,750, Oct. 3, 1985, abandoned.

[30] Foreign Application Priority Data

Oct. 3, 1984 [JP] Japan ..... 59-206200

[51] Int. Cl.[4] ..... D05B 47/04

[52] U.S. Cl. ..... 112/254; 112/278

[58] Field of Search ..... 112/254, 278

[56] References Cited

U.S. PATENT DOCUMENTS

| | | | |
|---|---|---|---|
| 4,215,641 | 8/1980 | Dobrjanskyj | 112/278 |
| 4,289,087 | 9/1981 | Takenoya et al. | 112/254 |
| 4,301,757 | 11/1981 | Tonomura | 112/254 |
| 4,702,185 | 10/1987 | Hanyu et al. | 112/254 |

*Primary Examiner*—Andrew M. Falik

*Attorney, Agent, or Firm*—Michael J. Striker

[57] ABSTRACT

An automatic thread tensioning device for positioning the crossing points of upper and lower threads in the center of thickness of a fabric undergoing stitching. The positioning is effected by making calculations based on measured results of thread tension, without needing to detect the various kinds of characteristics of fabrics, threads, or lower thread tension responding to an existing type of stitching condition. The proper upper thread tension may be determined for the stitching conditions of fabrics which have different characteristics and for stitching conditions of fabrics which have conventionally been difficult to deal with, simply by pressing buttons and making test stitchings. If an upper thread tensioning device has a motor, a stitching operation may be made more easily.

9 Claims, 8 Drawing Sheets

FIG_3
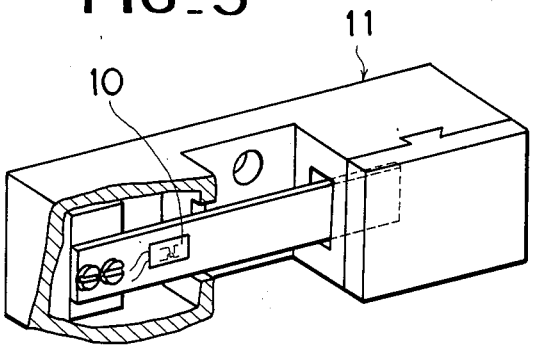
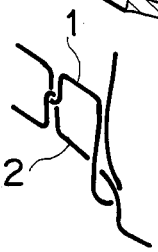
FIG_2(a)
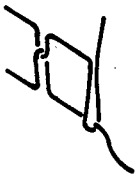
FIG_2(b)
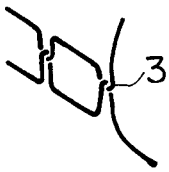
FIG_2(c)
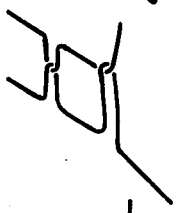
FIG_2(d)
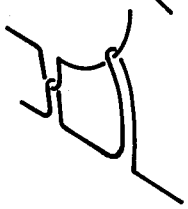
FIG_2(e)

FIG_4

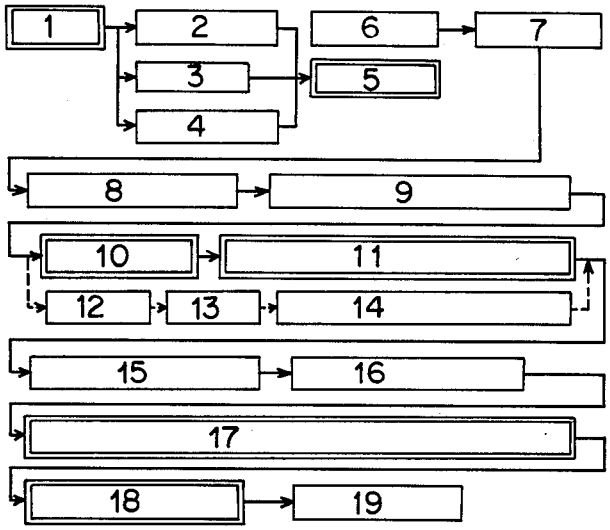

1. Operating start button
2. Second thread tension being activated
3. Sppcific stitch pattern selected
4. Upper thread tension measure circuit turned on
5. Operating controller
6. Sewing machine being driven
7. Test stitching being performed
8. Sewing machine stopped at a predetermined angular position $\theta_1$
9. Thread tension display being activated
10. Opening slide plate
11. Starting sewing machine by hand until bobbin starts to rotate
12. Sensor turned on
13. Sewing machine being started
14. Sensor detecting rotation of bobbin and operating to stop sewing machine
15. Thread tension being calculated
16. Thread tension displayed
17. Setting upper thread tension to value displayed
18. Selecting stitch pattern desired
19. Stitching being made possible FIG. 4A
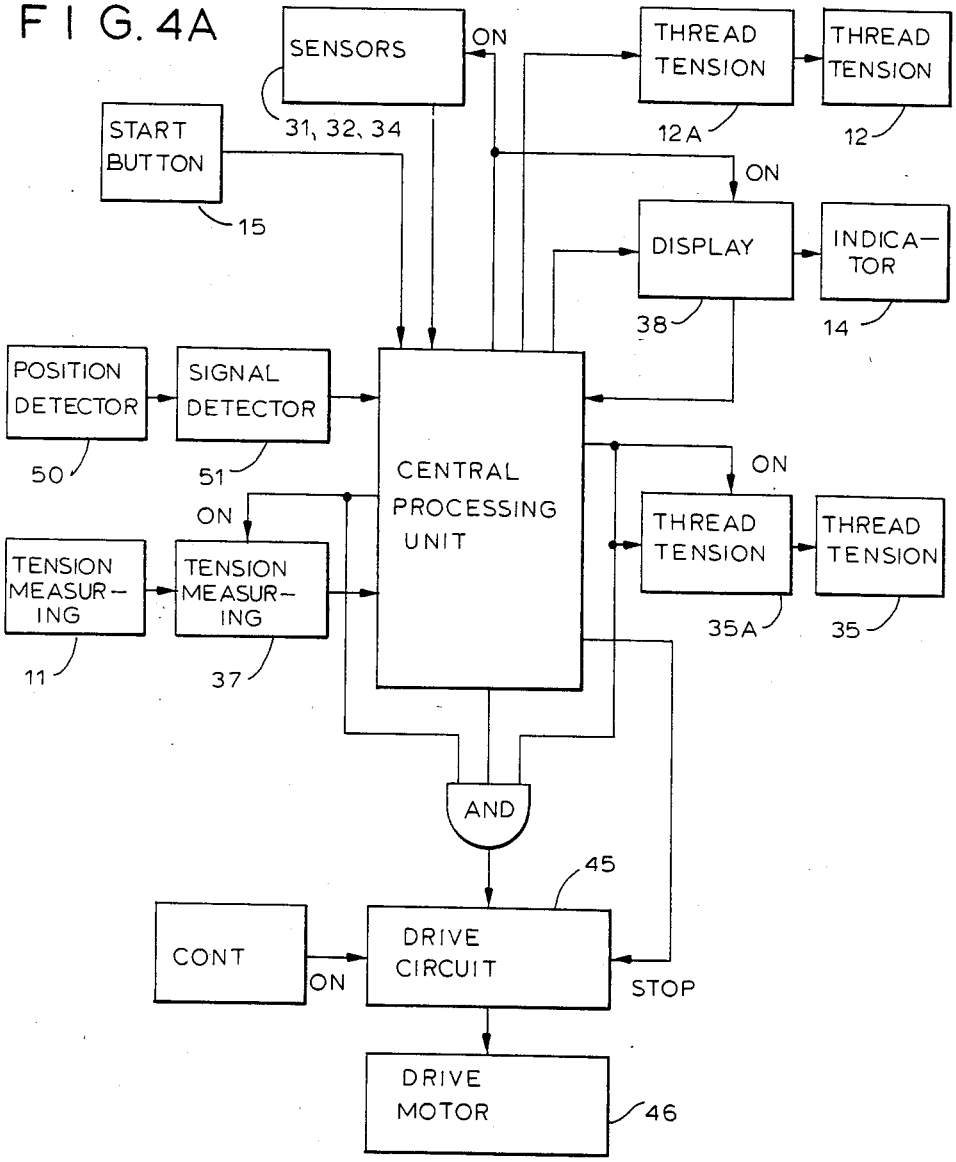
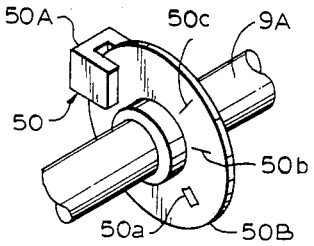
FIG. 12

FIG_10

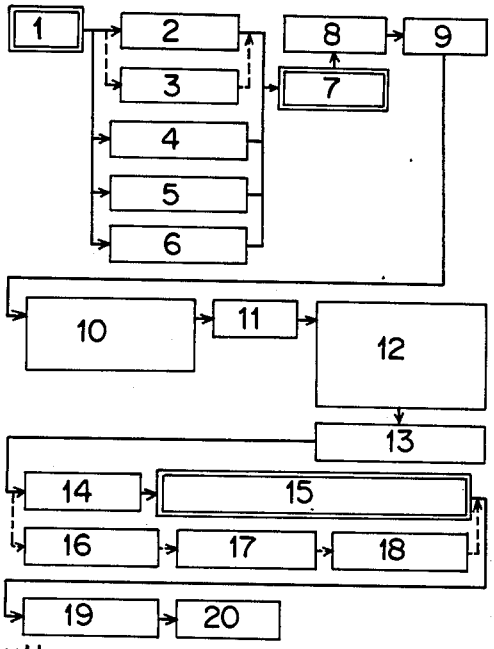

1. Operating start button
2. Second thread tension being activated
3. Upper thread tension at maximum
4. Specific stitch pattern selected
5. Upper thread tension measure circuit turned on
6. Lower thread tension measure circuit turned on
7. Operating controller
8. Sewing machine being driven
9. Test stitching being performed
10. Upper·lower thread tension A-D converter circuit ON
11. Sewing machine being started
12. Memory of upper·lower thread tension value in A-D converter between $\theta_1$ and $\theta_0$ of FIG.4
13. Caluculation of $T_2$ value of FIG.4
14. Thread tension displayed
15. Setting upper thread tension to value displayed
16. Motor of upper thread tension being driven
17. Setting upper thread tension
18. OK displayed in indicator
19. Selecting stitch pattern desired
20. Stitching being made possible

AUTOMATIC THREAD TENSION DEVICE FOR A SEWING MACHINE

CROSS-REFERENCE TO RELATED APPLICATIONS

This is a continuation-in-part of patent application Ser. No. 783,750, filed Oct. 3, 1985 abandoned.

BACKGROUND OF THE INVENTION

This invention relates to an automatic thread tension device of a sewing machine, which determines proper tension of upper and lower threads in response to stitching conditions such as a fabric to be sewn, the upper and lower threads and the tension of the lower thread.

An existing sewing machine is manually adjusted by a machine operator by means of an upper thread tension device in accordance with the stitching conditions such as the type of fabric, threads, patterns, feeding, stitching, lower thread tension, etc. The purpose for the adjustment is to regulate crossing points of the upper and lower threads in the thickness of the fabric under stitching.

There have been many proposals for automating the above mentioned regulation. However, such proposals are concerned with easily distinguishable patterns, feeding or stitching. Since characteristics of the fabrics and the threads vary, they are not completely distinguishable. Therefore, practical and useful proposals have not yet been realized.

SUMMARY OF THE INVENTION

The present invention has been devised in view of the above mentioned circumstances, and is in response to the stitching conditions of the various kinds of the fabrics, threads and the lower thread tension.

The invention relates to a sewing machine, more specifically, to an automatic thread tension adjusting device of a sewing machine, especially for adjusting the upper or needle thread tension in response to stitching conditions. Such stitching conditions include the thickness or types of fabric to be sewn, the size of a thread to be used, and the tension of a lower thread (bobbin thread). The tension of the lower thread is normally predetermined and constant.

Proper upper and lower thread tension implies the condition that the crossing points of the upper and lower threads (called briefly as "crossing position" hereafter) be positioned nearly in the center of thickness of the fabric. The crossing position is dependent upon the fabric, the thread and the lower thread tension.

On the other hand, this invention does not consider characteristics of the stitching conditions, but rather brings the crossing points to a proper position through association of the fabric, the threads and the lower thread tension.

In keeping with aforementioned objects, one aspect of the present invention resides in an automatic thread tension adjusting device for a sewing machine including an upper thread supply, a needle vertically reciprocable by rotation of an upper drive shaft to penetrate a fabric to be sewn to thereby form stitches in the fabric from an upper and lower thread, a thread take-up lever, a loop taker, a bobbin placed in the loop taker, the lower thread being wound up on the bobbin, the loop taker being rotatable in timed relation with the vertical reciprocating movement of the needle to interlock the upper thread with the lower thread, the upper thread being supplied from the upper thread supply to the needle through at least the thread take-up lever, the automatic thread tension adjusting device comprising: user-operated means including a start switch operated to produce a start signal; thread tensioning means arrangeable between the upper thread supply and the thread take-up lever, said thread tensioning means being responsive to said start signal for giving a predetermined tension to the upper thread; detecting means arrangeable between the thread take-up lever and the needle for detecting a tension of the upper thread, said detecting means being activated in response to a tension applied to the upper thread at a predetermined angular position of the upper drive shaft as the latter is rotated and producing a detected tension signal; and measuring means responsive to said detected tension signal for measuring therefrom the value of the tension applied to the upper thread and producing an output representing the measured value of the tension applied to the upper thread.

The automatic thread tension adjusting device further comprises calculating means responsive to said output of said measuring means to make a calculation based on said output to produce an output representing a calculated result; and display means responsive to said output from said calculating means for indicating said calculated result.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 2(*a*)–2(*e*) show explanatory views for crossing conditions of upper and lower threads;

FIG. 3 is a perspective view of an upper thread tension measuring part;

FIGS. 4 and 4A are explanatory views of operations and actuations of the invention;

FIGS. 10 and 10A are explanatory views of operations and actuations of the invention for determining proper thread tension by means of lower thread tension measuring part;

FIG. 12 is a perspective view of an angular position detector.

DETAILED DESCRIPTION OF PREFERRED EMOBDIMENTS

Figure 1:
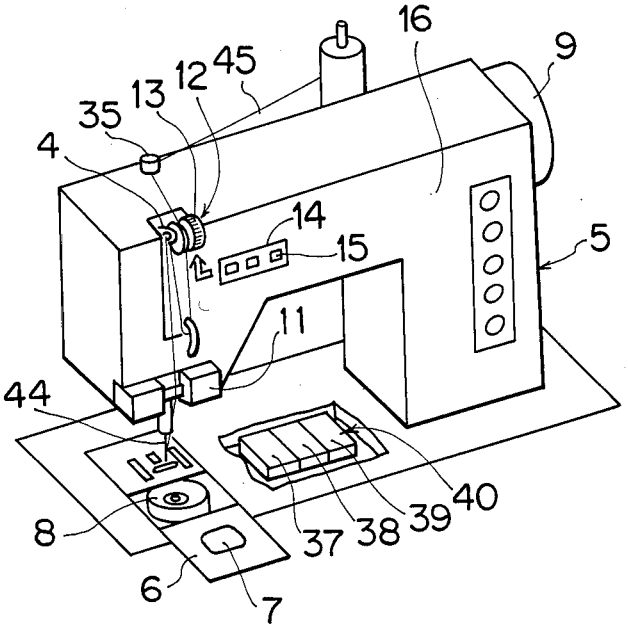
FIG. 1 is an outer appearance of a sewing machine bearing an embodiment of the invention.

FIGS. 2(*a*) to (*d*) illustrate the upper thread 1 and the lower thread crossing each other. The invention is based on an observation that there is a close relationship between the proper upper thread tension and a degree of the tension which is required for the upper thread to penetrate through the thickness of the fabric when point 3 of crossing of upper thread 1 and lower thread 2 is raised during the stitching as shown in FIGS. 2(*a*) to 2(*e*). The upper thread tension required to raise the crossing point is closely related to a period required for drawing out the lower thread. The upper thread tension is measured between a thread take-up lever and a needle at a phase of an upper shaft where a bobbin is rotated due to drawing-out of the lower thread just before the thread take-up lever reaches the upper dead point. The proper thread tension is determined by said measured value.

As is well known, the stitches are formed in a fabric (not shown) with the upper and lower threads 1 and 2 through the sequence of steps shown in FIGS. 2(*a*) through 2(*e*).

In the first step in FIG. 2(*a*), the upper thread 1 is interlocked with the lower thread 2 under the fabric. When the lower thread 2 is drawn out from a bobbin, the lower thread 2 is lifted to the next step shown in FIG. 2(*b*) by the upper thread 1 as a thread take-up lever goes up from the lower dead point thereof. As the thread take-up lever moves to the upper dead point, the interlocked point 3 of the upper and lower threads is lifted to the upper position above the fabric as shown in FIG. 2(*c*) generally between two superposed fabrics.

It may therefore be understood from this explanation that if a stitch is completed in the condition as shown in FIG. 2(*a*) or 2(*b*), the tension of the upper thread 1 is smaller than that of the lower thread 2 which is predetermined. If the stitch is completed to the condition shown in FIG. 2(*c*), the tensions of the upper and lower threads are balanced. On the other hand, if the stitch is completed to the condition shown in FIGS. 2(*d*) and 2(*e*) where the interlocked point 3 is located above the two superposed fabrics, the tension of the upper thread 1 is larger than that of the lower thread 2.

It is therefore an object to obtain the formation of a stitch as shown in FIG. 2(*c*) in any type of fabric to be sewn and with any size of thread to be used. In order to attain this object, the invention provides for measuring the tension of the upper thread extended between the thread take-up lever and the needle. The measurement takes place when the lower thread is beginning to be drawn out from the bobbin by the upper thread. The upper thread is lifted by the thread take-up lever, which is moved up near the upper dead point as the upper drive shaft is rotated in a predetermined angular distance.

A first embodiment of the invention is performed by a method of discriminating a period of drawing out the lower thread by observing a position of starting rotation of the bobbin.

In a sewing machine 5 with a horizontal loop taker as shown in FIGS. 1 and 3, the amount of the thread remaining on the bobbin 8 and the movement thereof may be easily observed by opening a plate 6 or through a transparent part 7 provided therein.

A machine frame 16 is provided with an upper thread tension measuring device 11 shown in FIG. 3 utilizing a strain gauge 10 for measuring the thread tension between the thread take-up lever 4 and a needle 44. An upper thread tension device 12 is provided that has a conventional dial measure 13, a start button 15 which starts relative actuations such as tension measuring, an indicator 14 showing the dial numeral 13 of the upper thread tension device 12 in response to the proper thread tension, and another thread tension device 35 which effects holding pressure in accordance with a signal from the start button 15.

There are housed within the machine frame 16 a signalling device 40 which includes a circuit 37 for measuring said thread tension, a circuit 39 comprising a micro-computer for calculating conditions for proper crossing of the upper and lower threads as a result of measuring the thread tension, and a circuit 38 for showing the dial measuring value 13 of said thread tension device 12 in the indicator 14.

The proper upper thread tension is determined by the signal of the start button 15 in a sequence shown in FIG. 4. Parts encircled with double rectangles will be operated by the machine operator.

FIG. 4 shows nineteen operation steps for stitching a selected pattern. These steps will be explained in detail herein below. If the start button 15, shown in FIG. 1, is depressed (step 1) and an electric signal is issued the second thread tension device 35 is actuated in response to said electric signal (step 2) as shown in FIG. 4A, to apply a holding pressure to the upper thread 45. The holding pressure is predetermined on the scale range 0–9 of the thread tensioning device 12 in the range between 7 and 9. The thread tensioning device becomes inactivated in response to said electric signal.

The housed signalling device 40 shown in FIGS. 1 and 4A sets a specific stitching condition (step 3) for measuring the upper thread tension required to raise the thread crossing point 3. The specific stitching condition includes a straight stitching with a fabric feeding amount about 2.5 mm. Simultaneously, the upper thread tension measuring circuit 37 (FIGS. 1 and 4A) is turned on (step 4).

Under this condition, in step 5, the machine operator manually sets a fabric and upper and lower threads in the sewing machine. As shown in FIG. 1 the upper thread 45 is extended from the thread supply to the needle 44 through the thread tension device 35, thread tension device 12, the thread checking spring located below the thread tension device 35, a thread take-up lever 4 and an upper thread tension measuring device 11 while the lower thread wound on the bobbin 8 is placed in the loop taker. The sewing machine is driven (step 6) and a test stitching is started.

The test stitching is continued (step 7) until a few stitches are made, and then the sewing machine is stopped (step 8) by a signal from the computer device 40 (FIGS. 1 and 10A) as will be explained more in detail. Namely the sewing machine is stopped with the upper shaft stopped at the rotational (or angular) position $\theta 1$ in FIG. 9 where the upper shaft is required to rotate more (20°–30°) until the bobbin starts to rotate when the lower thread is drawn out from the bobbin at the rotational phase $\theta 2$ of the upper shaft. The take-up lever is vertically moved in association with the rotation of an upper shaft. The phase of the upper shaft 9A is at a position of $\theta_1$ in FIG. 9, that is, prior to 20° to 30° of rotation of the bobbin 8. The sewing machine is stopped and the thread tension indicator is actuated (step 9). The sliding plate 6 is opened (step 10) and the pulley 9 is manually rotated (step 11), and when the bobbin is driven, the pulley is stopped. The rotation of the bobbin 8 implies that the lower thread is lifted by the upper thread as the thread take-up lever is raised. At this time, the upper thread tension measuring device or circuit 11 is operated to measure the upper thread actual tension. Depending upon results of measuring the upper thread tension at this time, a condition for providing the proper crossing of the upper and lower threads is calculated in computer device 40 (steps 15) and the calculated value is indicated on the indicator 14 (step 16) having 7-segment diodes for displaying 0–9.

Thread tension device 12 is of a conventional type and is substantially comprised of a thread clamping part and a dial 13 provided with a scale as shown in FIG. 1. Dial 13 is manually rotated, as known, to increase or reduce clamping pressure on the upper thread.

The machine operator manually operates the upper thread tension device to set the same to the value displayed in the indicator 14 and selects a pattern to be stitched. Thereafter, the stitching of the selected pattern is carried out.

Generally, a stitch pattern is selected by selectively operating pattern selecting switches. The pattern selecting switch is operated to produce a pattern signal for addressing a memory storing pattern data. The pattern signal may be simultaneously used as a reset signal to reset (inactivate) the second thread tension device 35 and other devices, and to set (activate) the first thread tension device 12.

When a desired stitch pattern is selected, the start button is rendered inoperative, and accordingly the second thread tension device 35 and the computerized ordering device 40 are made inoperative. Thus, all is ready for ordinary stitching. The proper thread tension may be shown continuously until a subsequent signal is issued by the button 15.

The second thread tension device 35 may be thread clamp actuated to clamp the upper thread with a predetermined pressure.

Figure 8:
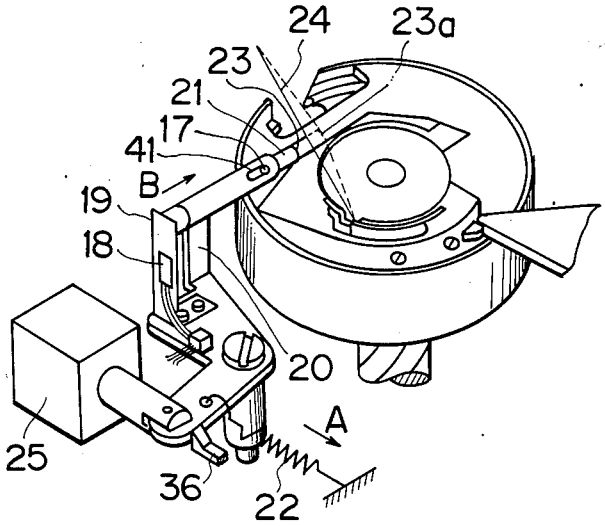
FIG. 8 is a perspective view of a lower thread tension measuring part.
Figure 5:
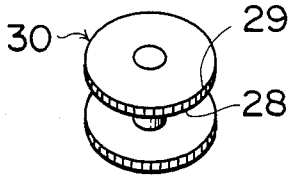
FIG. 5 is a perspective view of a bobbin to be used in another embodiment of the invention.
Figure 6:
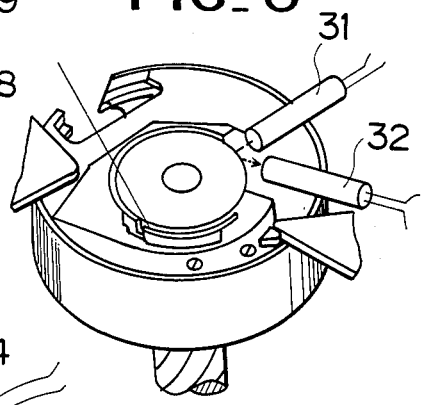
FIG. 6 is a perspective view of a detection mechanism using optical light for sensing the drawing-out of the lower thread.

Therefore, the first embodiment in FIGS. 1 and 4 has a first conventional thread tension device 12 and a second thread tension device 35. The first and second thread tension devices 12, 35 are replaced by a thread tension device 42 having a reversible motor 27 in the second embodiment in FIGS. 10 and 11. In the first embodiment the indicator 14 is operated to show a calculated thread tension value and it is required to manually set the first thread tension device 12 to the calculated value, but in the second embodiment the display shows "OK" because the motor 27 is driven in accordance with the thread tension calculation to set the thread tension 43 to a calculated value. The second embodiment does not require the device for detecting the rotation of the bobbin as shown in FIGS. 5 and 6 or in FIG. 7. Instead, the second embodiment requires the lower thread tension detecting device as shown in FIG. 8, and also requires a lower thread tension measuring circuit 6 in FIG. 10 in addition to the computerized means 40 in FIG. 1. In short, according to the first embodiment, the thread tension device 12 is manually set to a calculated value in reference to the value displayed at the indicator 14. In the second embodiment the thread tension device 42 is automatically set to a calculated value while the indicator 43 shows the indicator "OK". Therefore in the first embodiment the processes 10 and 11 in FIG. 4 may be neglected, and in the second embodiment the processes 2, 14 and 15 in FIG. 10 may be neglected.

Figure 10A:
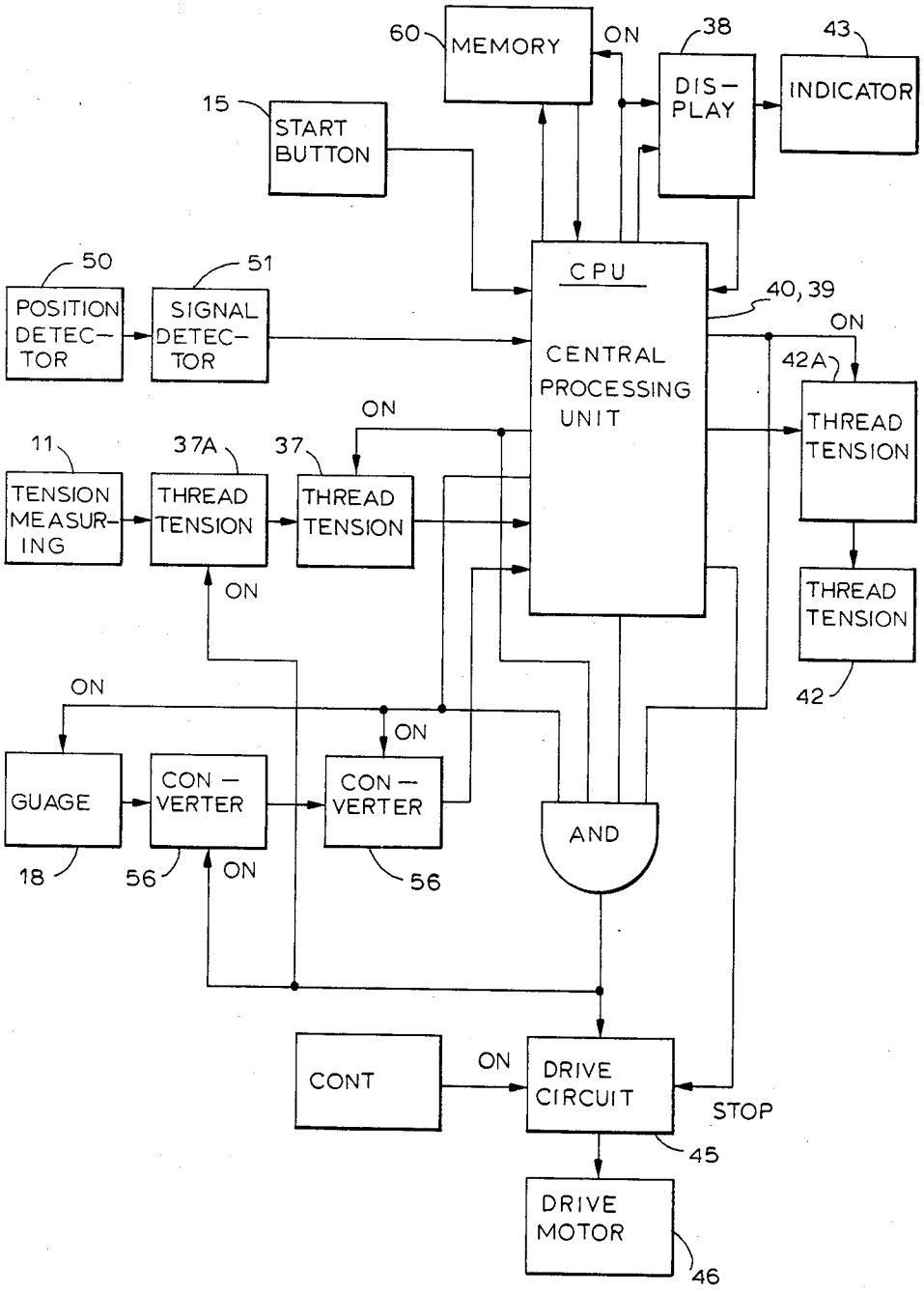

See FIGS. 4A and 10A. Their description is as follows:

In FIG. 4A, at first the start switch 15 is pressed to produce a start signal. A central processing unit CPU (computerized device 40) is responsive to the start signal to activate the second thread tension control circuit 35A to thereby activate the second thread tension device 35 and simultaneously inactivate a first thread tension activating circuit 12A to thereby inactivate the first thread tension device 12, and further to activate the upper thread tension measuring circuit 37 to be ready for measuring the strain of the strain gauge 11. Further, simultaneously the CPU is operated to designate a specific pattern (straight stitches) of the different stitch patterns stored in ROM.

Then the machine operator is required to depress a machine controller CONT to drive the sewing machine through a drive circuit 45 and a drive motor 46 to produce a few stitches. When a few stitches are produced, the sewing machine is automatically stopped with the upper shaft 9A stopped at the angular position $\theta 1$ in FIG. 9. Namely, as shown in FIG. 12 an angular position detector 50 is operated in timed relation with the rotation of the upper shaft 9A to produce a photo-signal. A signal detector 51 shown in FIG. 4A is operated in response to the photo-signal to produce an electric signal. The CPU is responsive to the electric signal to stop the upper shaft 9A at the angular position $\theta 1$ where the tension of the upper thread is 0.

The angular position detector 50 is as well known composed of a U-shaped element 50A secured to a machine housing having a light emitting diode (not shown) and a photo-transistor arranged opposite to each other and a disk 50B secured to the upper shaft for rotation therewith. The disk has a plurality of slits 50*a*, 50*b* formed thereon, and cooperate with the element 50A to shield the light between the light emitting diode and the photo-transistor, but allow the light to pass through the slits 50*a*, 50*b*. The slit 50*a* detects the angular position 0° of the upper shaft 9A and the slit 50*b* detects the angular position $\theta_1$.

The CPU is responsive to the signal of the detector detected at the slit 50*b* to inactivate the machine motor drive circuit 45 with the upper shaft 9A stopped at the angular position $\theta 1$ and simultaneously activate the sensor 31, 32 (step 12) or 34 and the indicator (display) circuit 38. The CPU is operated, on the condition that all are activated (the sensor 31, 32 or 34, the indicator circuit 38, the upper thread tension measuring circuit 37 and the second thread tension activating circuit 35A), to produce a signal to activate the machine motor drive circuit 45 through and an AND gate to drive the machine motor 46.

The upper shaft 9A is therefore rotated again (step 13) and the thread take-up lever 4 pulls up the upper thread which is concatenated with the lower thread, and accordingly the lower thread is drawn out from the bobbin and therefore the bobbin is rotated. The sensor 31, 32 or 34 detects the rotation of the bobbin (step 14) and produces an electric signal.

The CPU is responsive to the electric signal to stop the sewing machine with the upper shaft 9 stopped at the angular position $\theta 2$ where the upper thread is tensioned to give a strain to the strain gauge 11. The strain of the strain gauge 11 is measured at the measuring circuit 37. Then the CPU performs a calculation with the measured value and a functional formula stored in the CPU to produce a value to which the thread tension device 12 is adjusted to give to the upper thread the corresponding tension. The CPU displays the calculated value at the indicator 14 through the indicator circuit 38.

Then the machine operator manually sets the first thread tension device 12 to the value in reference to the displayed value. Subsequently, the machine operator may select an optional stitch pattern by selective operation of the pattern selecting switches. In this case the pattern signal is used to cause the CPU to address a pattern memory to read out the selected pattern data, and simultaneously to cause the CPU to inactivate the second thread tension device 35, the sensor 31, 32 or 34, the indicator (display) circuit 38 and the upper thread tension measuring circuit 37, and to activate (set free) the first thread tension activating circuit 12A.

A second embodiment of the invention is performed by a method of detecting a period of drawing out the lower thread by optically detecting the rotation of the bobbin.

The sewing machine 5 used in the first embodiment will be also used in the present embodiment, and is provided with a device for sensing the drawing-out of the lower thread shown in FIG. 6 in addition to the above mentioned upper thread measuring device 11. This device employs a bobbin 30 having reflection elements 29 on a flange face 28 as shown in FIG. 5. This device detects the rotation of the bobbin 30 by means of light sensors 31 and 32.

The proper thread tension is determined as shown with the dotted lines in FIG. 4, and this manner is substituted for determination of the period of drawing out the lower thread of the first embodiment, and other actuations are the same as said above.

The second embodiment of the invention is shown in FIGS. 10, 10A. The operation steps will be explained herein below with the reference to FIG. 10. When the start switch 15 is depressed (step 1), a start signal is issued. The central processing unit CPU is responsive to the start signal to activate an upper thread tension control circuit 42A (sep 2) to thereby set the upper thread tension device 42 to a predetermined set value (step 3), and simultaneously activate the upper thread tension measuring circuit 37 (step 5), and further simultaneously activate a lower thread tension measuring circuit 55 (step 6) and activate the lower thread tension detecting device (FIG. 8), and still further designate a specific pattern (straight stitches) of the different stitch patterns stored in ROM (step 4).

Then the sewing machine operator is required to depress the machine controller CONT (step 7) to drive the machine drive circuit 45 to thereby drive the sewing machine through the machine drive motor 46 (step 8) so as to produce a few stitches (step 9).

The angular position detector 50 detects the angular position $\theta 1$ of the upper shaft 9A and produces an electric signal after a few stitches have been produced. The CPU is responsive to the electric signal to inactivate the machine drive circuit 45 to thereby stop the machine drive motor 46, and simultaneously activate a memory device 60 and the indicator circuit 38 to thereby activate the indicator (display 43). The CPU is operated, on the condition that all are activated(the memory device 60, the indicator circuit 38, the upper thread tension measuring circuit 37, the lower thread tension measuring circuit 55 and the upper thread tension activating circuit 42A), to produce a signal through the AND gate to activate the machine drive circuit 45 (step 11) to thereby drive the machine drive motor 46, and simultaneously activate the analog-digital converting circuit 3A (step 10) for the upper thread tension gauge 11 and the analog-digital converting circuit 56 for the lower thread tension gauge 18.

When the sewing machine is driven again and the upper shaft 9A starts to rotate, the thread take-up lever 4 is moved up to tension the upper thread which accordingly starts to strain the strain gauge 11 until the thread take-up lever 4 comes to the upper dead point at the angular position $\theta 0$ of the upper shaft 9A, while the lower thread starts to be drawn out from the bobbin with a tensioned condition and strains the strain gauge 18 of the lower thread tension selecting device in FIG. 8.

The strains of the respective strain gauges 11, 18 are converted into digital signals respectively at the analog-digital converting circuits 37A, 56 and then measured at the respective tension measuring circuits 37, 55. The measured values of the upper and lower thread tensions are stored (step 12) in the memory device 60 through the CPU until the upper shaft 9A is stopped at the 20 angular position $\theta 0$ which is detected by the slit 50*c* of the detector 50, the electric signal of which causes the CPU to inactivate the machine drive circuit 45 to thereby stop the machine drive motor 46.

Simultaneously, in step 13, the CPU performs a calculation with the measured values of the upper and lower thread tensions stored in the memory device 60 and a functional formula; stored in the CPU to produce a value which is the most proper as the tension to be applied to the upper thread, and issues an output for displaying the calculated value (step 18) or simply an OK sign at the indicator 43 through the indicator circuit 38 and for simultaneously driving the upper thread tension control circuit 42A (step 16) to rotate the reversible motor 27 to thereby set the thread tension dial 42 to the calculated value (step 17).

Then if the machine operator selects an optional stitch pattern to be sewn by selective operation of the pattern selecting switches (step 19), the pattern signal may be used to cause the CPU to address a pattern memory to read out therefrom the selected pattern data and simultaneously cause the CPU to inactivate the memory device 60 (step 20), the indicator circuit 38, the upper thread tension control circuit 42A, the upper and lower thread tension measuring circuits 37, 55 and the lower thread tension gauge 18.

A third embodiment of the invention is performed by a method of detecting a period of drawing out the lower thread for measuring the upper thread tension by detecting the rotation of the bobbin by means of a magnet.

Figure 7:
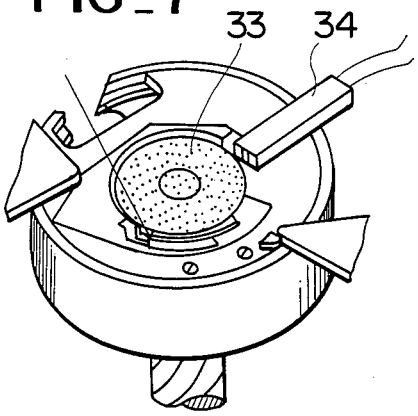
FIG. 7 is a perspective view of a detection mechanism using magnet for detecting bobbin position.

The sewing machine 5 used in the first embodiment will be also used in the present embodiment, and is provided with a device for sensing the drawing-out of the lower thread shown in FIG. 7, in addition to the above mentioned upper thread measuring device 11. This device employs a bobbin 33 containing magnetic particles, and will detect the rotation of the bobbin 33.

The proper thread tension is determined utilizing steps as shown with the dotted lines in FIG. 4. This sequence is substituted for determination of the period of drawing out the lower thread of the first embodiment and other actuations are the same as said above.

According to the invention, the manually operated requirements 10, and 11 may be replaced by the processes 12, 13 and 14 as shown by the dotted lines.

As shown in FIG. 4 and described, the upper thread tension is measured and calculated and then displayed after a few stitches have been produced on an optional fabric to be sewn.

A fourth embodiment of the invention is performed by a method of detecting a period of drawing out the lower thread for measuring the upper thread tension from continuous wave shapes of the lower thread tension.

The sewing machine 5 used in the first embodiment will be also used in the present embodiment, and is provided with a device for sensing the drawing-out of the lower thread shown in FIG. 8 in addition to the above mentioned upper thread measuring device 11. This device will be applied to the horizontal loop taker.

An actuating pin 21 is provided on a holder 20. The pin 21 is restrained against moving to the right by a pin 17 and a groove 41 and is restrained against moving to the left by a plate spring 19 securing the strain gauge 18, so that play is not present.

The holder 20 is a link pivoted to the machine frame 16 and is connected to a solenoid 25 with its other end. The numeral 22 is a spring pivoted to the machine frame 16 with its one end and connected to the holder 20 at its other end, and exert biasing in the direction indicated by arrow A. When no signal is issued, the spring 22 is positioned such that the end point 23 of the actuating pin 21 does not touch the lower thread 24 as shown with the solid line.

Figure 9:
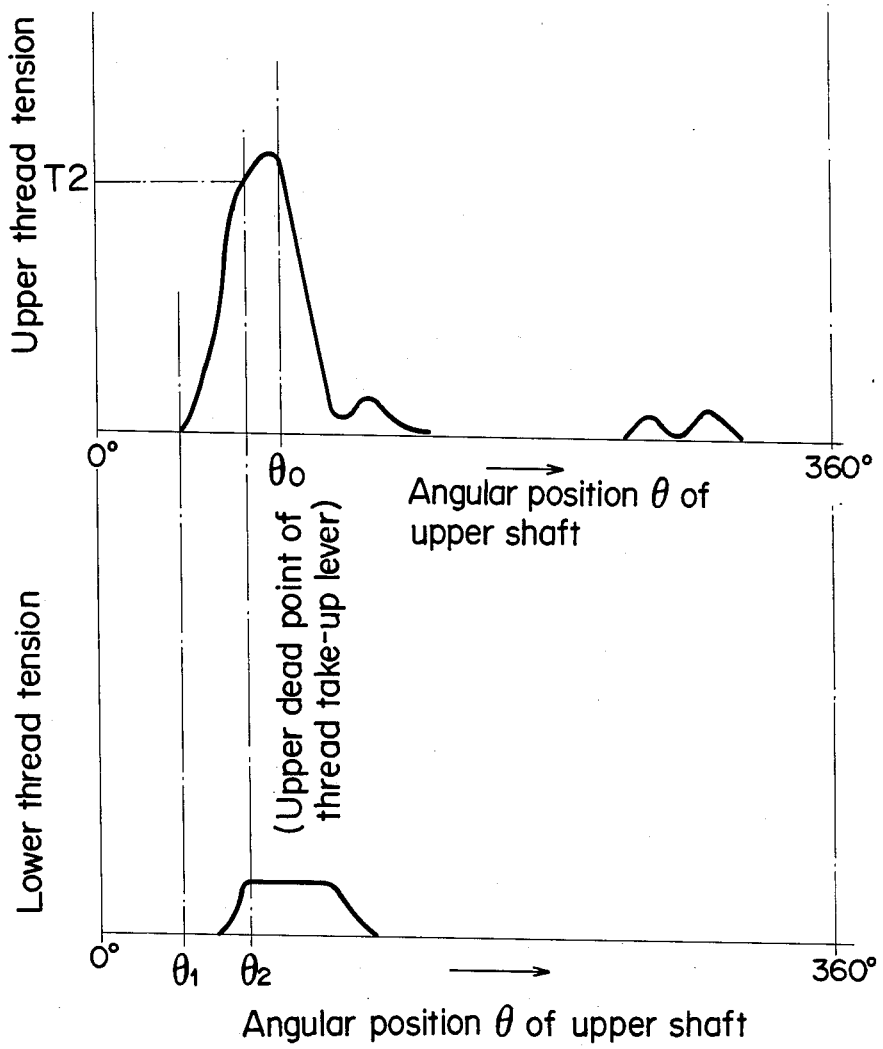
FIG. 9 is a diagram showing relationship between upper, lower thread tension and an upper shaft phase.

The actuation of the sensing device for drawing out the lower thread is carried out as mentioned below. If the start button 15 is pushed, the solenoid energizes and the pin 21 is moved in the direction indicated by arrow B, and its end 23*a* touches the lower thread 24 so as to measure the lower thread tension via the strain gauge 18 secured to the plate spring 19. The upper and lower thread tensions detected by the upper and lower thread tension devices are represented by curves as shown in FIG. 9. When the lower thread is drawn out, and since the lower thread tension is at a constant value, the drawing out of the lower thread is detected at the rotation or angular position $\theta 2$ of upper shaft 9A as depicted in FIG. 9.

In FIG. 9, a few stitches are produced at the angular position $\theta 1$ of the upper drive shaft, and subsequently the upper thread tension T2 at the angular position $\theta 2$ of the upper drive shaft is measured as applied to the strain gauge 11.

The upper thread tension is produced when the upper thread is concatenated with the lower thread and pulled up by the thread take-up lever. As the upper thread is pulled up, the lower thread is drawn out from the bobbin, and accordingly the bobbin is rotated. The rotation of the bobbin is detected by the sensor as shown in FIGS. 5–7. Then the sensor produces an electric signal to the computerized means 40 to stop the sewing machine. In short, the sewing machine is stopped when the upper thread tension T2 at the angular position 02 of the upper shaft 9A in FIG. 9 is applied to the strain gauge 11. The strain of the strain gauge 11 is measured, and the measured result is calculated with an optional function formula to produce a proper value of the upper thread tension to be manually set at the upper thread tension device 12.

The proper thread tension is set as shown with the solid lines in FIG. 10. The second thread tension device is actuated by the signal from the start button 15 as in the first embodiment, and at the same time the thread tension device 12 is loosened.

The specific stitching condition is ordered and set for measuring the thread tension, and the upper and lower thread tension measuring circuits are made operative. Under this condition, the machine operator sets a fabric and threads, and tries a test stitching. The test stitching is sufficient after a few stitches as in the first embodiment, and is stopped at a determine phase by a signal. The phase of the upper shaft may be about at the upper dead point of the needle bar. Subsequently, upper and lower thread tension A-D converting circuits are made operative, and the sewing machine is started. The stitching at this time is for measuring the upper and lower thread tension and determining the proper thread tension by a calculation of the values of the upper and lower thread tensions obtained at the angular position $\theta$ (T2) of the upper shaft in FIG. 9, the values being provided by converting the analog signals produced from the strain gauge 11 in FIG. 1 and the strain gauge 18 into the digital signals respectively. The subsequent indication of the proper thread tension is the same as in the first embodiment.

Figure 11:
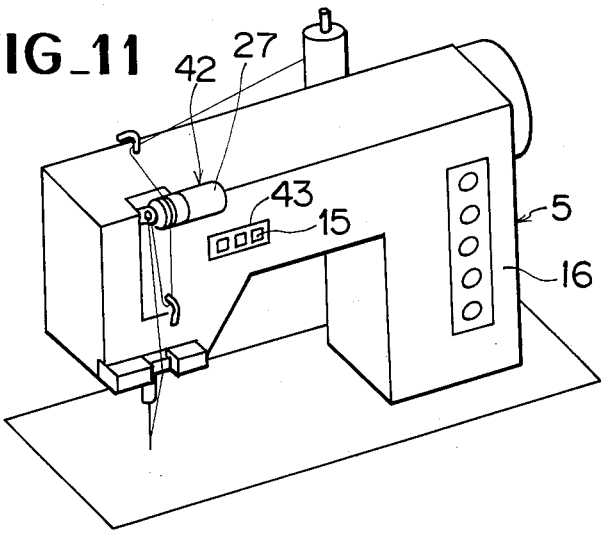
FIG. 11 is an outer appearance of an embodiment employing an upper thread tension by an electric motor.

In the present invention, such a device may be applied to all the above mentioned embodiments which is provided with the thread tension device 12 of FIG. 1, the indicating device for showing the dial numeral 13 in response to the proper thread tension, an upper thread tension means 42 which, as shown in FIG. 11, is substituted for the second thread tension device and is housed with a motor and a reduction gear in a housing part 27 for changing the upper thread tension by an electric order (signal), and an indicating device 43 for showing actuations. The operation at this case is carried out as shown with the dotted line in FIG. 10 and does not require the regulation of the upper thread tension device by the machine operator.

The present invention is not applied only to the above mentioned embodiments, for example, the horizontal bobbin carrier, but to other varied embodiments.

It will be understood that each of the elements described above, or two or more together, may also fine a useful application in other types of automatic thread tension devices of sewing machines differing from the types described above.

While the invention has been illustrated and described as embodied in a automatic thread tension device of a sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An automatic thread tension adjusting device for a sewing machine including an upper thread supply, a needle (44) vertically reciprocable by rotation of an upper drive shaft (9) to penetrate into a fabric to be sewn to thereby form stitches in the fabric from an upper and lower thread, a thread take-up lever (4) receiving an upper thread from the upper thread supply, a loop taker, a bobbin (8) placed in the loop taker, the lower thread being wound up on the bobbin, the loop taker being rotatable in timed relation with the vertical reciprocating movement of the needle to interlock the upper thread with the lower thread, the upper thread being supplied from the upper thread supply to the needle through at least the thread take-up lever, and user-operated means including a start switch (15) operated to produce a start signal for a sewing machine, the automatic thread tension adjusting device comprising:

thread tensioning means (12,35) positioned between the upper thread supply and the thread take-up lever, said thread tensioning means being responsive to said start signal for giving a predetermined tension to the upper thread;

detecting means (11) positioned between the thread take-up lever and the needle for detecting a tension of the upper thread, said detecting means being activated in response to a tension applied to the upper thread at a predetermined angular position of the upper drive shaft as the latter is rotated and producing a detected tension signal;

measuring means (37) responsive to said detected tension signal for measuring therefrom the value of the tension applied to the upper thread and producing an output representing the measured value of the tension applied to the upper thread;

calculating means (39,40) responsive to said output of said measuring means to produce an output calculated value; and display means (14,43) responsive to said output calculated value from said calculating means for indicating said calculated output value, whereby said thread tensioning is adjusted to give to said upper thread a tension corresponding to said calculated output value.

2. The device as defined in claim 1, said detecting means comprising sensor means for sensing said predetermined angular position of the upper drive shaft.

3. The device as defined in claim 2, wherein said sensor means includes reflecting elements positioned around the bobbin, and includes photo-sensor means, said reflecting elements and said photo-sensor means cooperating to sense the rotation of the bobbin as the lower thread is drawn out therefrom when the upper drive shaft is rotated.

4. The device as defined in claim 2, wherein said sensor means includes magnetic particles contained in said bobbin and a permanent magnet, said magnetic particles and said permanent magnet cooperating with each other to sense the rotation of the bobbin as the lower thread is drawn out therefrom.

5. The device as defined in claim 1, wherein said tensioning means includes first means (12) for manually adjusting the upper thread tension, and second means (35) for adjusting the thread tension and being located between the upper thread supply and the manually adjustable first upper thread tension means, said manually adjustable first upper thread tension means being responsive to said start signal for becoming inoperative, said second thread tension means being responsive to said start signal for giving the upper thread said predetermined tension.

6. An automatic thread tension adjusting device for a sewing machine including an upper thread supply, a needle (44) vertically reciprocable by rotation of an upper drive shaft (9) to penetrate into a fabric to be sewn to thereby form stitches in the fabric from an upper and lower thread, a thread take-up lever (4) receiving an upper thread from the upper thread supply, a loop taker, a bobbin (8) placed in the loop taker, the lower thread being wound up on the bobbin, the loop taker being rotatable in timed relation with the vertical reciprocating movement of the needle to interlock the upper thread with the lower thread, the upper thread being supplied from the upper thread supply to the needle through at least the thread take-up lever, and user-operated means including a start switch (15) operated to produce a start signal, the automatic thread tension adjusting device comprising:

thread tensioning means (12, 35) positioned between the upper thread supply and the thread take-up lever, said thread tensioning means being responsive to said start signal for giving a predetermined tension to the upper thread;

detecting means (11) arrangable between the thread take-up lever and the needle for detecting a tension of the upper thread, said detecting means being activated in response to a tension applied to the upper thread at a predetermined angular position of the upper drive shaft as the latter is rotated and producing a detected tension signal;

first measuring means (37) responsive to said detected tension signal for measuring therefrom the value of the tension applied to the upper thread and producing an output representing the measured value of the tension applied to the upper thread;

second measuring means (18, 55, 56) for measuring the tension of the lower thread as the lower thread is drawn out from the bobbin as the upper drive shaft is rotated, said second measuring means producing an output based on sensing a measured value of the lower thread tension;

calculating means (40, 39) responsive to said output of said first measuring means and said output of said second measuring means to produce an output representing a calculated value; and control means (27) operated in response to said output from said calculating means to set said upper thread tensioning means (42) to said calculated value.

7. The device as defined in claim 6, wherein said lower thread tension measuring means includes a strain gauge and a pin having one end operatively connected to said strain gauge and the other end engageable with the lower thread.

8. The device as defined in claim 6, wherein said detecting means includes a strain gauge.

9. The device as defined in claim 6, further comprising display means (43) responsive to said output from said calculating means for indicating said calculated value.

* * * * *